US007938399B2

(12) United States Patent
Kawaguchi

(10) Patent No.: US 7,938,399 B2
(45) Date of Patent: May 10, 2011

(54) SHEET CONVEYING APPARATUS, IMAGE FORMING APPARATUS, AND IMAGE READING APPARATUS

(75) Inventor: Daisuke Kawaguchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 12/466,575

(22) Filed: May 15, 2009

(65) Prior Publication Data

US 2009/0224465 A1 Sep. 10, 2009

Related U.S. Application Data

(62) Division of application No. 11/743,358, filed on May 2, 2007, now Pat. No. 7,537,210.

(30) Foreign Application Priority Data

May 26, 2006 (JP) ..... 2006-147174

(51) Int. Cl.
*B65H 7/02* (2006.01)

(52) U.S. Cl. ..... 271/227; 271/228

(58) Field of Classification Search ..... 271/227, 271/228

See application file for complete search history.

(56) References Cited

U.S. PATENT DOCUMENTS

| | | | | |
|---|---|---|---|---|
| 5,078,384 | A | 1/1992 | Moore | |
| 5,362,041 | A | 11/1994 | Ryuzaki et al. | 271/236 |
| 5,681,036 | A | 10/1997 | Wakahara et al. | |
| 6,059,285 | A | 5/2000 | Suga et al. | |
| 6,533,268 | B2 | 3/2003 | Williams et al. | |
| 6,733,008 | B2 | 5/2004 | Waragai et al. | 271/242 |
| 6,866,260 | B2 | 3/2005 | Williams et al. | |
| 6,974,128 | B2 | 12/2005 | Quesnel | |
| 7,537,210 | B2 * | 5/2009 | Kawaguchi | 271/226 |
| 2006/0022400 | A1 | 2/2006 | Kawasaki et al. | |
| 2006/0208416 | A1 * | 9/2006 | Dejong et al. | 271/228 |
| 2007/0292180 | A1 | 12/2007 | Suzuki et al. | |
| 2008/0237975 | A1 * | 10/2008 | de Jong et al. | 271/228 |
| 2008/0296835 | A1 * | 12/2008 | Dejong et al. | 271/227 |

FOREIGN PATENT DOCUMENTS

| | | |
|---|---|---|
| EP | 1 508 839 A2 | 2/2005 |
| JP | 02-043850 | 3/1990 |
| JP | 4-313541 | 11/1992 |
| JP | 08-081089 | 3/1996 |

(Continued)

OTHER PUBLICATIONS

Official Letter/Search Report, dated Jun. 10, 2009, issued by the European Patent Office, in European Patent Application No. 07107333.2.

(Continued)

*Primary Examiner* — David H Bollinger
(74) *Attorney, Agent, or Firm* — Fitzpatrick, Cella, Harper & Scinto

(57) ABSTRACT

A curved conveying guiding portion which guides a sheet toward a skew correcting unit is provided on a sheet conveying direction upstream of the skew correcting unit which corrects a skew of the sheet by rotating the sheet while conveying it. By narrowing an interval in the vertical direction in a center portion in the lateral direction of the conveying guiding portion, when a sheet S is rotated and corrected by the skew correcting unit, a load which the sheet to be corrected receives from the conveying guiding portion is reduced.

14 Claims, 11 Drawing Sheets

FOREIGN PATENT DOCUMENTS

| | | |
|---|---|---|
| JP | 8-108955 | 4/1996 |
| JP | 09-249332 | 9/1997 |
| JP | 10-175752 | 6/1998 |
| JP | 2003-54788 | 2/2003 |

OTHER PUBLICATIONS

European Official Action, dated Feb. 10, 2011, issued in European Application No. 07107333.2.

* cited by examiner

SHEET CONVEYING APPARATUS, IMAGE FORMING APPARATUS, AND IMAGE READING APPARATUS

This is a divisional of U.S. patent application Ser. No. 11/743,358, filed May 2, 2007, allowed Mar. 30, 2009, and expected to issue as U.S. Pat. No. 7,537,210 on May 26, 2009.

BACKGROUND OF THE INVENTION

1. Field of the Invention

The present invention relates to a sheet conveying apparatus, an image forming apparatus, and an image reading apparatus and, more particularly, to a construction for correcting a skew of a sheet such as recording paper, original document, or the like which is conveyed to one of an image forming unit and an image reading unit.

2. Description of the Related Art

Hitherto, an image forming apparatus or an image reading apparatus such as copying apparatus, printer, or facsimile apparatus has a sheet conveying apparatus for conveying a sheet such as recording paper, or original document (hereinbelow, also referred to as an original) to an image forming unit or an image reading unit. The sheet conveying apparatus has a skew correcting unit for correcting a skew of the sheet in order to correct a posture of the sheet or adjust a position of the sheet until it is conveyed to the image forming unit or the image reading unit.

As a correcting system of such a skew correcting unit, there is a loop registration system using a registration roller pair. According to such a system, for example, in the case of the image forming apparatus, a front edge of the sheet is hit against a nip of the registration roller pair which is in the stop state, a deflection is formed in the sheet, and thereafter, the sheet leading edge is curved along a roller nip by elasticity of the sheet, thereby correcting the skew of the sheet. In the case of the image forming apparatus, after the skew was corrected as mentioned above, the registration roller pair is rotated at predetermined timing, thereby matching position of the sheet leading edge with that of a front edge of an image.

However, in recent years, in the image forming apparatus or the image reading apparatus, digitization of processes has been progressed. In association with such digitization, for example, in the image forming apparatus, an interval between the sheets (distance between a rear edge of the precedent sheet and a front edge of the subsequent sheet: hereinbelow, referred to as a sheet interval) is narrowed, thereby enabling many sheets to be processed for a short period of time. Thus, an image forming speed can be substantially improved without raising a processing speed for forming the image.

For example, in a conventional analog copying apparatus, in the case of continuously copying, since an optical apparatus for exposing the original has to be reciprocated by a distance corresponding to the number of copy sheets, the sheet interval adapted to copy information of the original has inevitably been determined.

However, since the processes for reading the original and forming the image are digitized, after the original was read once, the image information is electrically encoded and stored into a memory. Upon image creation, the image information in the memory is read out and an image corresponding to the image information is formed on a photosensitive member in the image forming unit by a laser beam or an exposing apparatus such as an LED array. Thus, a mechanical motion of the optical apparatus or the like which is repeated a plurality of number of times becomes unnecessary even in the case of copying a plurality of print copies. Therefore, a time which is required for the sheet registration mentioned above becomes one of large factors upon determination of the sheet interval.

However, since the foregoing loop registration system has the construction in which the deflection is formed in the sheet and the skew of the sheet is corrected by the elasticity of the sheet, in other words, the sheet is temporarily stopped and the skew of the sheet is corrected, a time which is required for the registration becomes long.

Therefore, as a correcting system proposed in order to shorten the time which is required for the registration, there is a system for correcting the skew while conveying the sheet. As such a correcting system, there is an active registration system using: two sensors arranged on a sheet conveying path on a coaxial line which perpendicularly crosses a sheet conveying direction; and a pair of skew correcting rollers which are independently driven. Such a technique has been disclosed in Japanese Patent Application Laid-Open No. H08-108955.

According to such a system, first, an inclination of a front edge of the sheet is detected based on timing when the sheet leading edge traverses the two sensors. After that, by controlling a sheet conveying speed of each of the skew correcting rollers based on the detection of the inclination of the sheet leading edge, the skew of the sheet is corrected.

FIG. 11 illustrates a construction of a sheet conveying apparatus for correcting the skew by such an active registration system. The sheet conveying apparatus has: a registration unit 7 for correcting the skew of the sheet; and a sheet conveying unit 8 which is arranged on the upstream in the sheet conveying direction of the registration unit 7 and has a plurality of rollers 5*a* and 6*a* each having a semicircular cross section.

When a sheet edge detecting unit (not shown) detects the sheet leading edge, the semicircular rollers 5*a* and 6*a* are rotated a predetermined number of times at the same phase. By this rotation, a sheet S is sent to the registration unit 7. After that, while the sheet is conveyed, the skew of the sheet S is corrected in the registration unit 7.

When the sheet S is sent to the registration unit 7 as mentioned above, the semicircular rollers 5*a* and 6*a* are away from rollers 5*b* and 6*b* and stopped in the state where the sheet S is not held. By constructing in such a manner that when the sheet is sent to the registration unit 7, the semicircular rollers 5*a* and 6*a* do not hold the sheet S as mentioned above, a rear edge side of the sheet is not restricted. Thus, even if the sheet conveying speed is high, the sheet can be continuously conveyed at a minimum interval while maintaining high skew correcting precision.

Another reasonable sheet position matching system for printing at a high speed in which a movement amount of a mass is small has also been proposed. The system executes both of the skew correcting operation of the sheet and the re-positioning operation for matching the side positions of the sheet in the integrated system. Such a technique has been disclosed in Japanese Patent Application Laid-Open No. 2003-054788.

In one of the image forming apparatus and the image reading apparatus, such a skew correction is extremely important to improve one of image forming precision and image reading precision. It is demanded to further improve the skew correcting precision.

Such skew correcting precision largely depends on a "conveying load of the sheet" as a load which the sheet receives from a guide surface of a sheet conveying guide and a "conveying force of the skew correcting roller". To raise the skew correcting precision, a relation of "conveying load of the sheet<conveying force of the skew correcting roller" has to be always satisfied. If "conveying load of the sheet>conveying force of the skew correcting roller", the skew cannot be corrected. Even in the case near such a relation, a slip occurs between the sheet and the skew correcting roller and the skew correction is insufficient, thereby deteriorating the correcting precision.

Particularly, in the case of curving a sheet conveying path on the upstream of the skew correcting roller in order to miniaturize the apparatus, a contact pressure of the sheet and the sheet conveying guide is increased by a repulsion of a deflection of the sheet, the conveying load is also increased, and the skew correcting precision deteriorates remarkably.

Further, in association with the spread of the recent color copying apparatuses and the like, what is called thick paper in which a weight per unit area is large is often used. Therefore, a technique for coping with such thick paper is demanded. However, since a rigidity of thick paper is large, the repulsion of the deflection increases and the conveying load increases, thereby further deteriorating the skew correcting precision.

Therefore, there has also been proposed an apparatus in which in order to correct the skew at high precision even in a situation of a large conveying load, a conveying roller pair which is moved in the direction (hereinbelow, referred to as a lateral direction) which perpendicularly crosses the sheet conveying direction is provided, thereby assisting the motion of the skew correction of the sheet. Such a technique has been disclosed in Japanese Patent Application Laid-Open No. H10-175752.

However, in such conventional sheet conveying apparatus and image forming apparatus, there is such a tendency that even when the conveying roller pair which is moved in the lateral direction is provided, in recent years, if a variety of many types of sheets are used, the conveying load cannot be sufficiently reduced and the skew correcting precision deteriorates.

If it is intended to increase the conveying force of the skew correcting roller pair in order to improve the skew correcting precision, the contact pressure of the skew correcting roller pair increases. If the contact pressure of the skew correcting roller pair increases as mentioned above, not only the durability deteriorates but also a large torque is necessary, causing an increase in motor size. Thus, the costs increase and the apparatus size increases.

SUMMARY OF THE INVENTION

The invention is made in consideration of such circumstances and it is an object of the invention to provide a sheet conveying apparatus, an image forming apparatus, and an image reading apparatus in which skew correcting precision of a sheet can be improved without increasing a size of the apparatus.

According to the invention, there is provided a sheet conveying apparatus for conveying a sheet, comprising: a skew correcting unit which corrects a skew of the sheet by rotating and conveying the sheet; a conveying guiding portion which is provided on an upstream in a sheet conveying direction of the skew correcting unit and guides the sheet to the skew correcting unit; and a projecting portion provided in the conveying guiding portion, which comes into slide contact with the sheet rotated by the skew correcting unit so as to correct the skew.

Further features of the present invention will become apparent from the following description of exemplary embodiments with reference to the attached drawings.

DESCRIPTION OF THE EMBODIMENTS

An exemplary embodiment for embodying the invention will be described in detail hereinbelow with reference to the drawings.

Figure 1:
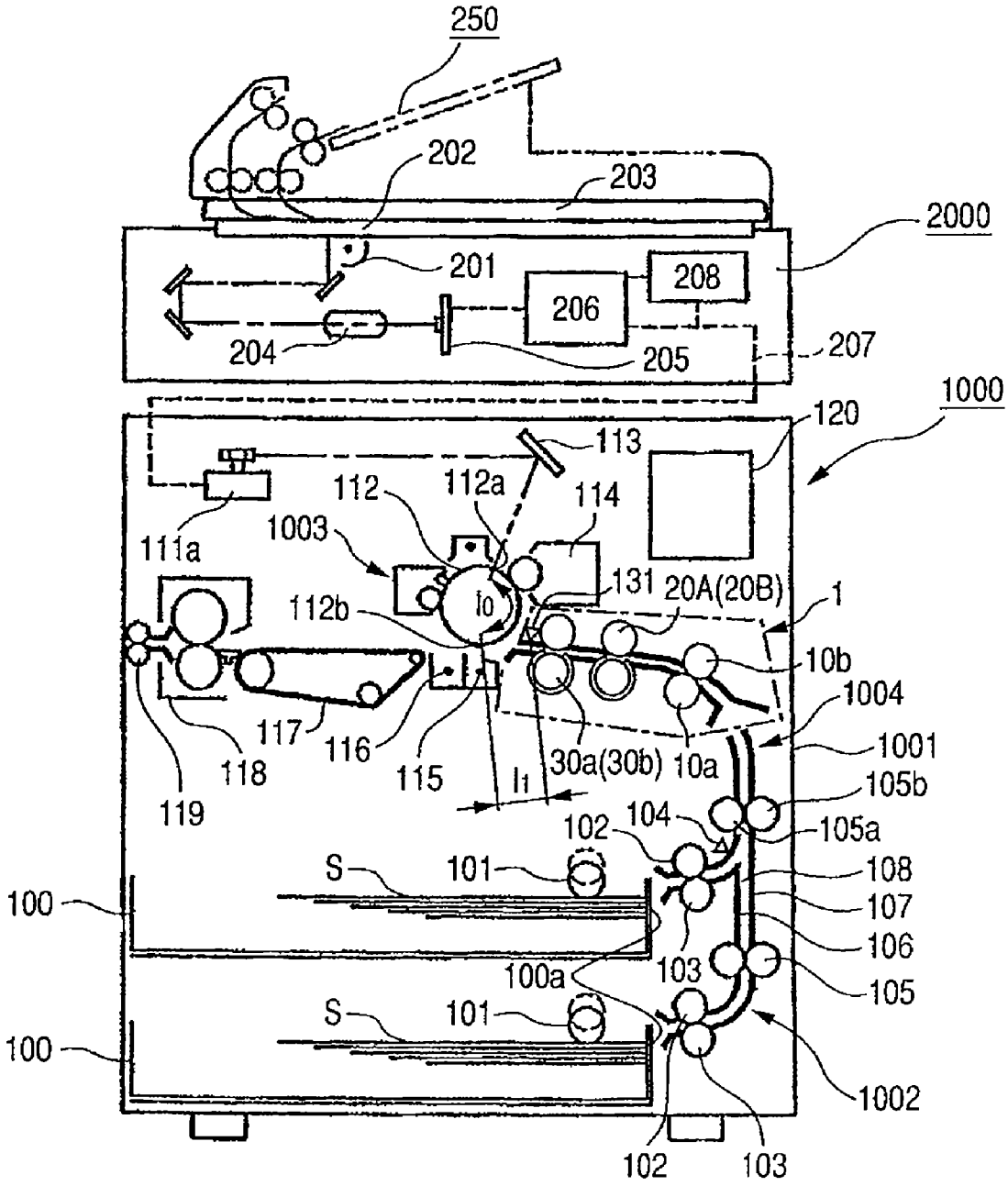
FIG. 1 is a schematic constructional diagram of a printer as an example of an image forming apparatus having a sheet conveying apparatus according to the first embodiment of the invention.

FIG. 1 is a schematic constructional diagram of a printer as an example of an image forming apparatus having a sheet conveying apparatus according to the first embodiment of the invention.

In FIG. 1, a printer 1000 has: a printer main body 1001; and a scanner 2000 arranged on an upper surface of the printer main body 1001.

The scanner 2000 for reading an original document (hereinbelow, also referred to as an original) has: a scanning optical system light source 201; platen glass 202; and an original pressing plate 203 which is freely opened and closed. The scanner 2000 also has: a lens 204; a photosensing element (photoelectric conversion) 205; an image processing unit 206; a memory unit 208 for storing an image processing signal processed by the image processing unit 206; and the like.

When the original is read, light is irradiated from the scanning optical system light source 201 onto the original (not shown) put on the platen glass 202. The read original image is processed by the image processing unit 206, thereafter, converted into an electric signal 207 which has electrically been encoded, and transmitted to a laser scanner 111*a* as an image forming unit. Image information which has been processed by the image processing unit 206 and encoded can be also temporarily stored into the memory unit 208 and transmitted to the laser scanner 111*a* as necessary in response to a signal from a controller 120.

The printer main body 1001 has: a sheet feeding apparatus 1002; a sheet conveying apparatus 1004 for conveying the sheet S fed by the sheet feeding apparatus 1002 to an image forming unit 1003; and the controller 120 as a control unit for controlling the printer 1000.

The sheet feeding apparatus 1002 has: sheet cassettes 100; pickup rollers 101; and separating units each of which is constructed by a feed roller 102 and a retard roller 103. The sheets S in the cassette 100 are separated and fed one by one by the operation of the pickup roller 101 which is elevated up and down and rotated at predetermined timing and the separating unit.

The sheet conveying apparatus 1004 has: a conveying roller pair 105 (105*a*, 105*b*); and a registration roller unit 1 having a conveying roller pair 10 (10*a*, 10*b*), skew correcting roller pairs (20A, 20B), and a registration roller pair 30 (30*a*, 30*b*).

The sheet S fed by the sheet feeding apparatus 1002 is conveyed by the conveying roller pair 105, passes through a sheet conveying path 108 constructed by guide plates 106 and 107, and thereafter, is guided to the registration roller unit 1. After that, in the registration roller unit 1, a skew of the sheet is corrected as will be described hereinafter and, subsequently, the sheet S is conveyed to the image forming unit 1003.

The image forming unit 1003 is of an electrophotographic system and has: a photosensitive drum 112 as an image bearing member; the laser scanner 111*a* as an image writing unit; a developing unit 114; a transfer charging unit 115; and a separating charging unit 116.

When an image is formed, first, a laser beam emitted from the laser scanner 111*a* is folded back by a mirror 113 and irradiated to an exposing position 112*a* on the photosensitive drum which rotates clockwise, so that a latent image is formed on the photosensitive drum. After the latent image was formed on the photosensitive drum in this manner, it is developed as a toner image by the developing unit 114.

Subsequently, the toner image developed on the photosensitive drum as mentioned above is, thereafter, transferred onto the sheet S by the transfer charging unit 115 in the transfer unit 112*b*. A distance between the laser beam irradiating position 112*a* on the photosensitive drum 112 and a transfer unit 112*b* is assumed to be $l_0$.

Further, the sheet S on which the toner image has been transferred as mentioned above is electrostatically separated from the photosensitive drum 112 by the separating charging unit 116. Thereafter, the sheet is conveyed to a fixing device 118 by a conveying belt 117 and the toner image is fixed and, subsequently, the sheet is ejected by a discharge roller 119.

According to the printer 1000, in the sheet conveying path until the sheet is ejected by the discharge roller 119 after the sheet was fed from the sheet feeding apparatus 1002, the sheet is conveyed by what is called a "center reference" in which it is conveyed while setting a center of the conveying path to a reference. The invention is not limited to the printer of the center reference but can be also used in a printer of what is called a one-side reference in which one of the sides in the lateral direction of the sheet is set to a reference.

In FIG. 1, a skew detecting sensor 131 is provided. When the skew detecting sensor 131 detects the sheet S which has passed through the registration roller pair 30, the controller 120 sends a sheet leading edge signal (image edge signal) to the laser scanner 111*a* based on a detection signal of the sensor 131 after the elapse of, for example, T seconds as will be described hereinafter. Thus, the irradiation of the laser beam by the laser scanner 111*a* is started.

Although the printer main body 1001 and the scanner 2000 have separately been provided in the embodiment, there is also a case where the printer main body 1001 and the scanner 2000 are integratedly provided. Although the printer main body 1001 is provided separately from or integratedly with the scanner 2000, when the processing signal of the scanner 2000 is input to the laser scanner 111*a*, the printer main body 1001 functions as a copying apparatus and when a transmission signal from a facsimile apparatus is input, the printer main body 1001 functions as a facsimile apparatus. Further, when an output signal of a personal computer is input, the printer main body 1001 also functions as a printer. On the contrary, if the processing signal of the image processing unit 206 of the scanner 2000 is transmitted to another facsimile apparatus, the printer main body 1001 functions as a facsimile apparatus. In the scanner 2000, if an automatic document feeder (hereinafter, abbreviated to an ADF) 250 as shown by a section surrounded by an alternate long and two-short dashes line is attached in place of the original pressing plate 203, the originals can be also automatically read.

Figure 2:
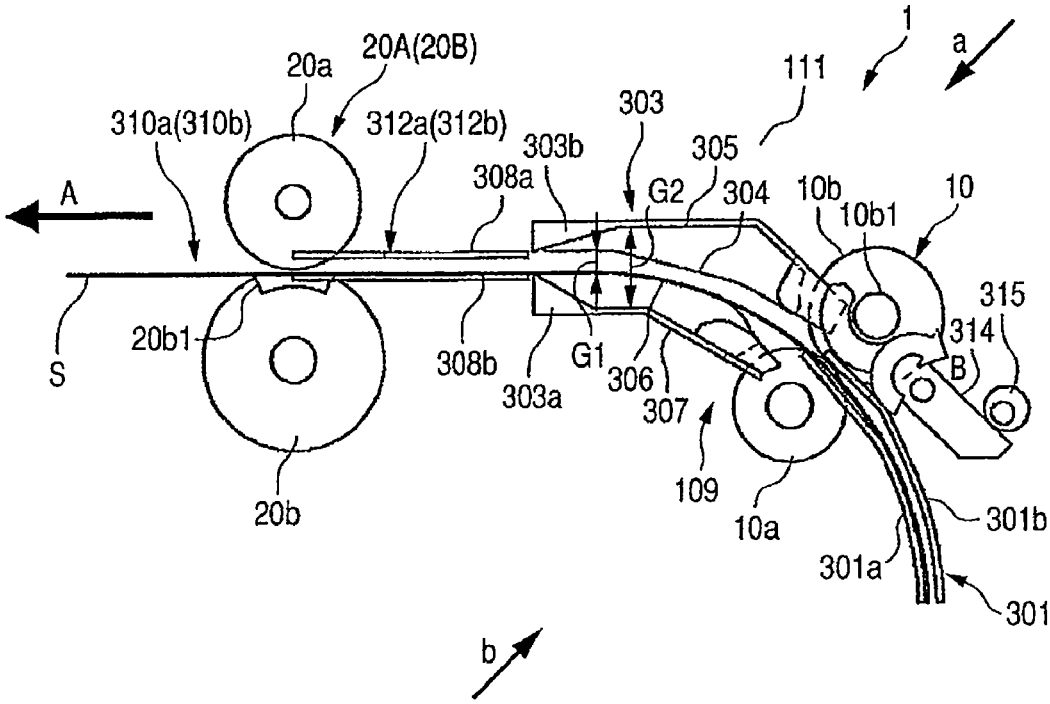
FIG. 2 is a diagram for illustrating a construction of a registration roller unit provided for the sheet conveying apparatus.
Figure 3:
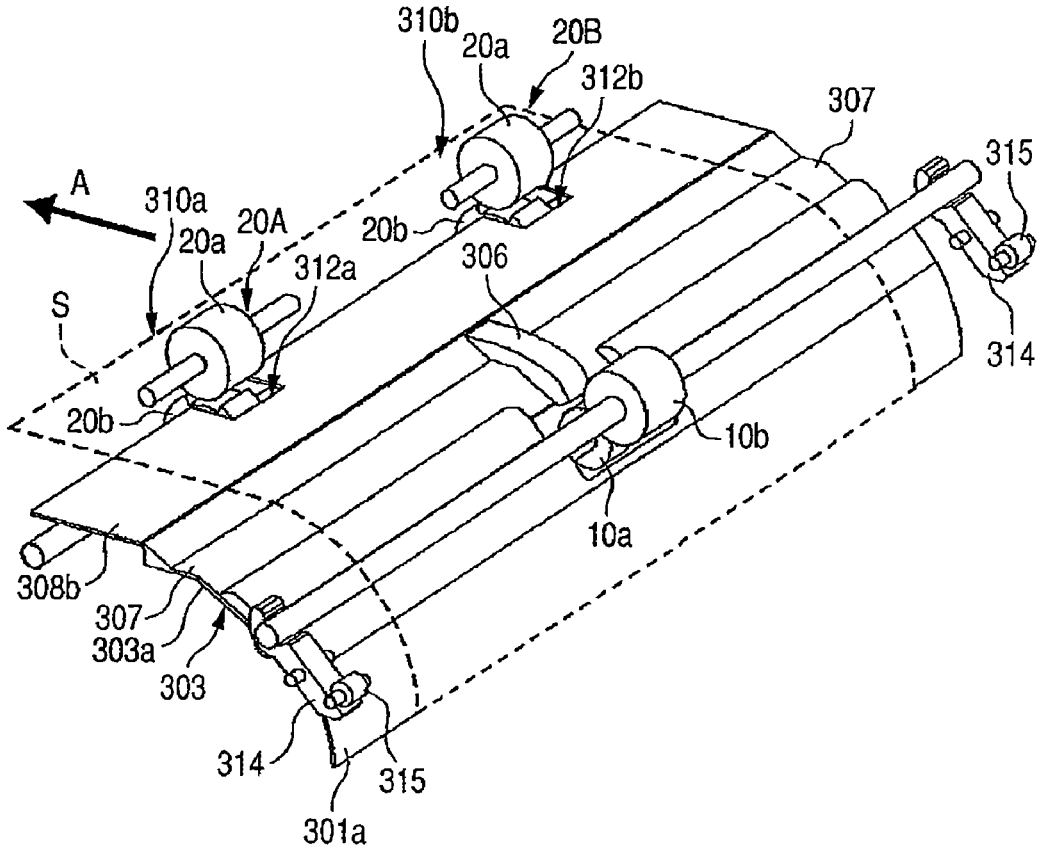
FIG. 3 is a perspective view when seen in the direction of an arrow a in FIG. 2.
Figure 4:
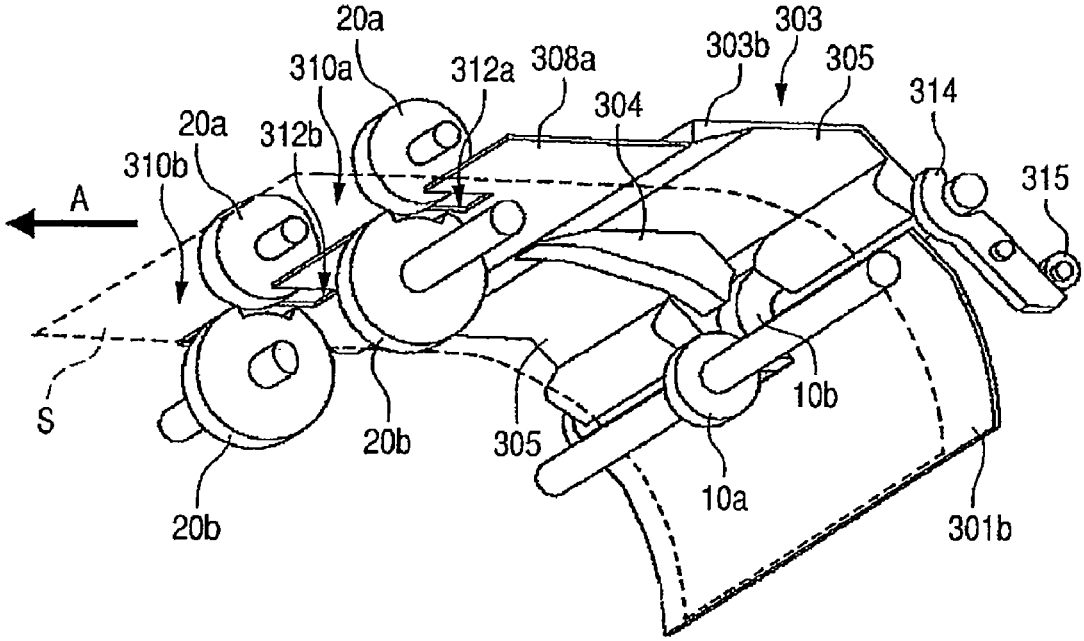
FIG. 4 is a perspective view when seen in the direction of an arrow b in FIG. 2.

FIG. 2 is a diagram for illustrating a construction of the registration roller unit 1. FIG. 3 is a perspective view when seen in the direction of an arrow a in FIG. 2. FIG. 4 is a perspective view when seen in the direction of an arrow b in FIG. 2. In FIGS. 3 and 4, a part of guides is not illustrated in order to express the inside of a conveying path. In FIGS. 2, 3 and 4, the sheet S is conveyed in the direction of an arrow A.

In FIGS. 2, 3 and 4, an upstream curved conveying guiding portion 301 guides the sheet S conveyed from the conveying roller pair 105. The upstream curved conveying guiding portion 301 is constructed by an upstream upper curved guide 301*a* and an upstream lower curved guide 301*b*. The conveying roller pair 10 (10*a*, 10*b*) conveys the sheet S guided by the upstream curved conveying guiding portion 301 to the skew correcting roller pairs (20A, 20B) as skew correcting units in the state of the curved sheet S.

One roller 10*a* of the conveying roller pair 10 is a conveying driving roller which is driven by a driving source (not shown) and generates a conveying force to the sheet. The other roller 10*b* is a conveying driven roller which is come into pressure contact with the conveying driving roller 10*a* by a pressing unit such as a spring or the like (not shown) and sandwiches the sheet.

Figure 5:
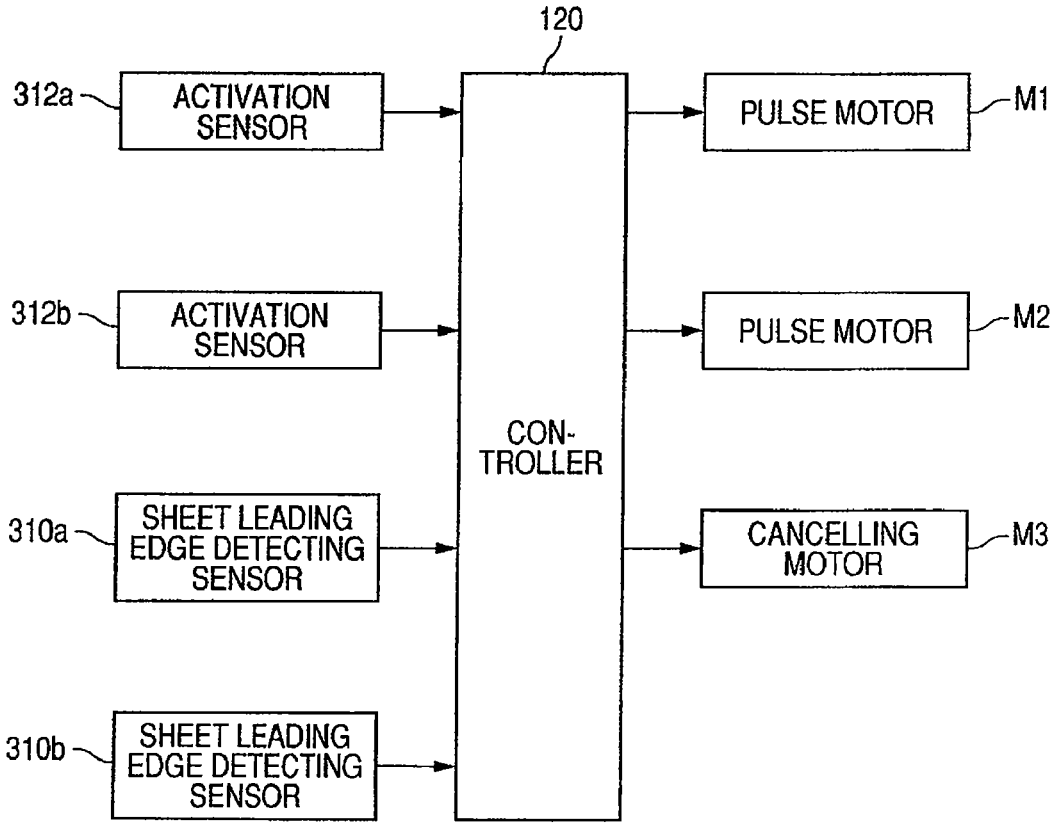
FIG. 5 is a control block diagram of the sheet conveying apparatus.

The conveying driven roller 10*b* (an axis 10*b*1 thereof) is supported by a pressure cancelling arm 314 which is rotated in the direction of an arrow B by a pressure cancelling cam 315 which is rotated by a cancelling motor M3 shown in FIG. 5. As will be described hereinafter, when the skew of the sheet is corrected, by the rotation of the pressure cancelling arm 314 in the direction of the arrow B associated with the rotation of the pressure cancelling cam 315, the conveying driven roller 10*b* is moved in such a direction as to cancel a nip which is formed between the conveying driving roller 10*a* and the conveying driven roller 10*b*.

A downstream curved conveying guiding portion 303 guides the sheet S conveyed by the conveying roller pair 10 to the skew correcting roller pairs (20A, 20B). The downstream curved conveying guiding portion 303 is constructed by a downstream upper curved guide 303*b* and a downstream lower curved guide 303*a*. A curved conveying guiding portion 109 for guiding the sheet S in the curved state is constructed by the downstream curved conveying guiding portion 303 and the upstream curved conveying guiding portion 301. Straight guides 308*a* and 308*b* finally guide the sheet S guided by the downstream curved conveying guiding portion 303 to the skew correcting roller pairs (20A, 20B). Surfaces of the downstream upper curved guide 303*b*, downstream lower curved guide 303*a*, and straight guides 308*a* and 308*b* which are come into slide contact with the sheet construct a sheet guiding surface.

In a center portion of the downstream upper curved guide 303*b* in the lateral direction, an outside center-guiding portion 304 as a projecting portion for guiding an upper center portion of the sheet S which passes through the downstream curved conveying guiding portion 303 is formed in the sheet conveying direction so as to be projected. As illustrated in FIG. 4, outside side-guiding surfaces 305 locating on both sides of the outside center-guiding portion 304 are located in the outer side in the radial direction from the surface of the outside center-guiding portion 304 adapted to guide the sheet.

In a center portion of the downstream lower curved guide 303*a* in the lateral direction, an inside center-guiding portion 306 as a projecting portion for guiding a lower center portion of the sheet S which passes through the downstream curved conveying guiding portion 303 is formed in the sheet conveying direction so as to be projected. As illustrated in FIG. 3, inside side-guiding surfaces 307 locating on both sides of the inside center-guiding portion 306 are located in the inner side in the radial direction from the surface of the inside center-guiding portion 306 adapted to guide the sheet.

As mentioned above, by denting the both sides of the center portions, the projecting portions are formed in the center portions.

Therefore, in the downstream curved conveying guiding portion 303, an interval in the center portion in the lateral direction, that is, an interval G2 between the outside side-guiding surface 305 and the inside side-guiding surface 307 is larger than an interval G1 between the outside center-guiding portion 304 and the inside center-guiding portion 306. That is, by forming the inside center-guiding portion 306 on the downstream lower curved guide 303*a* so as to be projected and by forming the outside center-guiding portion 304 on the downstream upper curved guide 303*b* so as to be projected, the interval G1 in the vertical direction of the center portion of the downstream curved conveying guiding portion 303 is narrowed.

An interval between both side portions of the downstream curved conveying guiding portion 303 in the lateral direction, that is, the interval G2 between the inside side-guiding surface 307 of the downstream lower curved guide 303*a* and the outside side-guiding surface 305 of the downstream upper curved guide 303*b* is wider than the interval G1 in the center portion. By constructing as mentioned above, spaces are formed in both edge portions of the downstream curved conveying guiding portion 303 in the lateral direction.

Thus, as will be described hereinafter, when the skew is corrected by the skew correcting roller pairs (20A, 20B), the sheet is conveyed while being guided by the center portion of the downstream curved conveying guiding portion 303. At this time, the sheet is conveyed while permitting a torsional deformation of the sheet which is caused when the skew is corrected by the spaces formed in the both edge portions of the downstream curved conveying guiding portion 303 in the lateral direction.

The skew correcting roller pairs (20A, 20B) is coaxially provided. One roller 20*b* constructing each of the skew correcting roller pairs (20A, 20B) is a skew correcting driving roller arranged coaxially in the lateral direction. The rollers 20*b* are connected to pulse motors M1 and M2 serving as driving sources and illustrated in FIG. 5, thereby enabling rotational speeds of the pulse motors M1 and M2 to be independently controlled. The other roller 20*a* constructing each of the skew correcting roller pairs (20A, 20B) is a skew correcting driven roller similarly arranged coaxially in the lateral direction. The rollers 20*a* are come into pressure contact with the skew correcting driving rollers 20*b* by the pressing units (not shown), thereby sandwiching the sheet.

In the embodiment, a part of the peripheral surface of the skew correcting driving roller 20*b* is omitted. As illustrated in FIG. 2, when such a notch portion 20*b*1 exists at a position where it faces the skew correcting driven roller 20*a*, the nip between the skew correcting driving roller 20*b* and the skew correcting driven roller 20*a* is cancelled.

Two optical activation sensors 312*a* and 312*b* are arranged at a predetermined interval in the lateral direction in an upstream just near the skew correcting roller pairs (20A, 20B). Two optical sheet leading edge detecting sensors 310*a* and 310*b* are also arranged at a predetermined interval in a downstream of the skew correcting roller pairs (20A, 20B).

As shown in FIG. 5, the activation sensors 312*a* and 312*b* and the sheet leading edge detecting sensors 310*a* and 310*b* are connected to the controller 120. First, the controller 120 detects a skew amount of the sheet leading edge based on detection signals from the activation sensors 312*a* and 312*b*. The rotational speeds of the pulse motors M1 and M2 are increased or decreased according to the skew amount, thereby increasing or decreasing the sheet conveying speeds of the skew correcting roller pairs (20A, 20B) and correcting the skew of the sheet leading edge.

Similarly, based on detection signals from the sheet leading edge detecting sensors 310*a* and 310*b*, the controller 120 discriminates whether or not the skew has been corrected by the sheet conveying speed control of the first time based on the detection signals from the activation sensors 312*a* and 312*b*. If it is determined that the skew is not corrected, the controller 120 detects the skew amount of the sheet leading edge based on the signals from the sheet leading edge detecting sensors 310*a* and 310*b* and increases or decreases the rotational speeds of the pulse motors M1 and M2 according to the detected skew amount, thereby correcting the skew of the sheet leading edge.

Subsequently, the sheet skew correcting operation of the registration roller unit 1 constructed as mentioned above will now be described. First, the sheet S fed out of the cassette 100 by the sheet feeding apparatus 1002 as already mentioned above is conveyed by the conveying roller pair 105 and, thereafter, passes through the conveying roller pair 10. After that, a driven roller 105*b* is nip-cancelled every sheet size as necessary by a roller cancelling motor (not shown).

Subsequently, when the front edge of the sheet S conveyed by the conveying roller pair 10 is detected by the activation sensors 312*a* and 312*b*, the pulse motors M1 and M2 are activated based on the detection signals from the activation sensors 312*a* and 312*b*. Thus, as illustrated in FIG. 2, the skew correcting driving roller 20*b* of each of the skew correcting roller pairs (20A, 20B) which has been stopped at the position where the nip portion is cancelled is rotated, so that the sheet S is conveyed.

Figure 6:
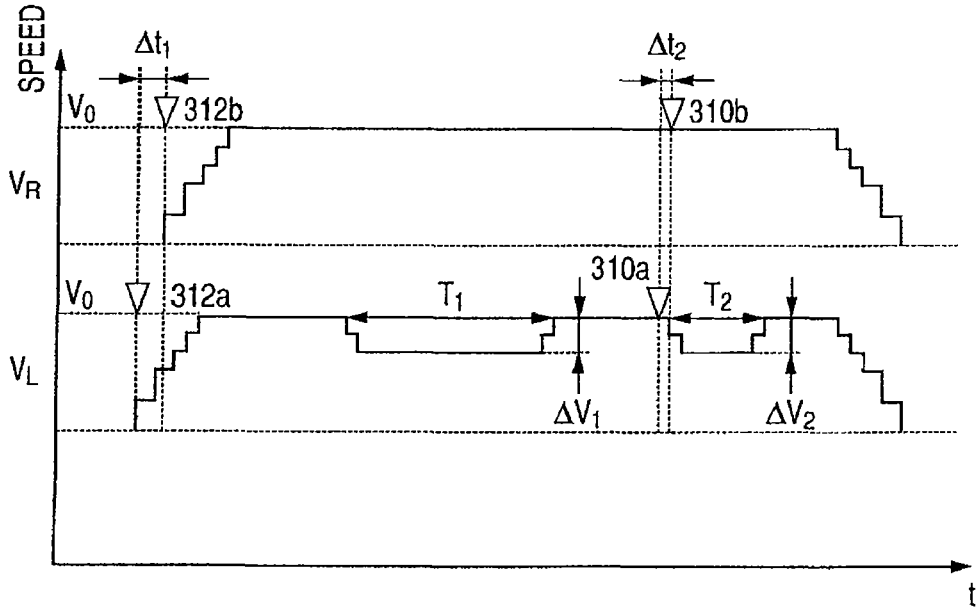
FIG. 6 is a diagram for illustrating control of a motor rotational speed of the sheet conveying apparatus.

At this time, the controller 120 calculates the skew amount of the sheet leading edge from a detection time difference $\Delta t_1$ between the activation sensors 312*a* and 312*b* illustrated in FIG. 6. For example, if the activation sensor 312*a* first detected the sheet, the skew correcting driving roller 20*b* of the skew correcting roller 20A is decelerated. After that, the controller 120 calculates a correcting time $T_1$ and a decelerating speed $\Delta V_1$ as control parameters for making the skew correction so as to satisfy the following equation (1).

$$V_0 \times \Delta t_1 = \int_{T_1} \Delta V_1 dt \quad (1)$$

After the sheet entered the nip of the skew correcting roller 20B, the controller 120 makes the speed control as illustrated in FIG. 6 according to the calculated parameters. Thus, the sheet S is conveyed while rotating and the skew is corrected.

There is a case where the conveying roller pair 10 sandwiches a rear edge of the sheet S during the skew correcting operation depending on the sheet size. In such a case, the controller 120 drives the cancelling motor M3 so as to rotate the pressure cancelling cam 315 for a period of time until the skew correcting operation is started after the sheet S entered the nip of the skew correcting roller.

Thus, the pressure cancelling arm 314 is rotated in the direction of the arrow B as illustrated in FIG. 2. The conveying driven roller 10*b* is moved in such a direction as to cancel the nip between the conveying driving roller 10*a* and the conveying driven roller 10*b*. Thus, it is possible to prevent the conveying roller pair 10 from becoming a load upon rotating of the sheet. After completion of the skew correction, the pressure cancelling cam 315 is rotated in the opposite direction, thereby allowing the conveying driven roller 10*b* to be come into pressure contact with the conveying driving roller 10*a*.

Subsequently, after such a skew correcting operation was finished, the front edge of the sheet S is similarly detected by the sheet leading edge detecting sensors 310*a* and 310*b* (refer to FIG. 6). If a detection time difference $\Delta t_2$ between the sheet leading edge detecting sensors 310*a* and 310*b* is equal to or larger than a predetermined value, the controller 120 calculates a correcting time $T_2$ and a decelerating speed $\Delta V_2$ as control parameters for making the skew correction of the second time so as to satisfy the following equation (2).

$$V_0 \times \Delta t_2 = \int_{T_2} \Delta V_2 dt \tag{2}$$

After that, as illustrated in FIG. 6, the skew correcting roller pairs (20A, 20B) make the speed control of the second time according to the calculated parameters, thereby making the skew correction of the second time. To enable the speed control of the second time according to such a skew correction to be made, it is necessary to set the sheet leading edge detecting sensors 310*a* and 310*b* to the positions on the downstream in the conveying direction of the sheet leading edge position at the end of the skew correcting operation of the first time. By such speed control of the second time, the sheet S is conveyed while rotating and the skew is corrected.

During such a skew correcting operation, the sheet S is pulled out of the upstream curved conveying guiding portion 301 and the downstream curved conveying guiding portion 303 illustrated in FIG. 2 in the curved state while rotating. If it is intended to correct the skew of the sheet S in the curved state as mentioned above, a force adapted to cause a torsional deformation acts on the sheet S.

If the interval in the center portion of the downstream curved conveying guiding portion 303 in the lateral direction is equal to the interval in each of both edge portions, since the shape of the sheet is restricted by the guiding surfaces, the sheet is difficult to be deformed. Thus, if the force adapted to cause the torsional deformation acts on the sheet S upon correcting the skew, the sheet S receives a reaction from the guiding surfaces of the downstream curved conveying guiding portion 303 and such a reaction appears as a conveying load of the sheet upon correcting the skew. This conveying load becomes a cause of a slip between the skew correcting roller pairs (20A, 20B) and the sheet and becomes a cause of deterioration in skew correcting precision.

In the embodiment, therefore, the interval G2 between the outside side-guiding surface 305 and the inside side-guiding surface 307 of the downstream curved conveying guiding portion 303 with which the sheet S which is curved and conveyed as mentioned above is come into slide contact is larger than the interval G1 between the outside center-guiding portion 304 and the inside center-guiding portion 306. By constructing as mentioned above, spaces adapted to enable the sheet to be deformed are formed in the both edge portions of the downstream curved conveying guiding portion 303 in the lateral direction. Therefore, upon correcting the skew, the sheet enters a state where both side portions of the sheet are easily deformed.

Thus, upon correcting the skew, in the downstream curved conveying guiding portion, the sheet S is guided while being come into slide contact with the outside center-guiding portion 304 and the inside center-guiding portion 306. On the outside side-guiding surface 305 and the inside side-guiding surface 307, the sheet S is conveyed while being torsion-deformed.

Since the sheet S is easily torsion-deformed according to the acting force of the skew correcting rollers upon correcting the skew, the sheet is easily rotated and the skew is corrected. Thus, the sheet is conveyed in a balanced state and the skew correcting precision can be improved.

By narrowing the interval G1 in the center portion of the downstream curved conveying guiding portion 303 in the lateral direction as mentioned above, when the sheet is rotated and the skew is corrected by the skew correcting roller pair (20A, 20B), the load which the sheet to be corrected receives from the downstream curved conveying guiding portion 303 can be reduced.

Therefore, when the sheet is active-registration corrected, the sheet can be easily torsion-deformed and rotated. It is difficult to cause a slip between the sheet and the skew correcting roller pairs (20A, 20B). Consequently, the sheet conveying load upon correcting the skew of the sheet can be reduced by a simple construction. The skew correcting precision of the sheet can be improved without enlarging the apparatus size.

Although the nip of the conveying roller pair 10 has been cancelled during the skew correcting operation so as not to become the load on the rotating of the sheet in the embodiment, in place of cancelling the nip, the conveying roller pair can be also moved in the direction which perpendicularly crosses the conveying direction.

The second embodiment of the invention in which the conveying roller pair is moved in the direction which perpendicularly crosses the conveying direction at the time of such a skew correcting operation of the sheet will now be described.

Figure 7:
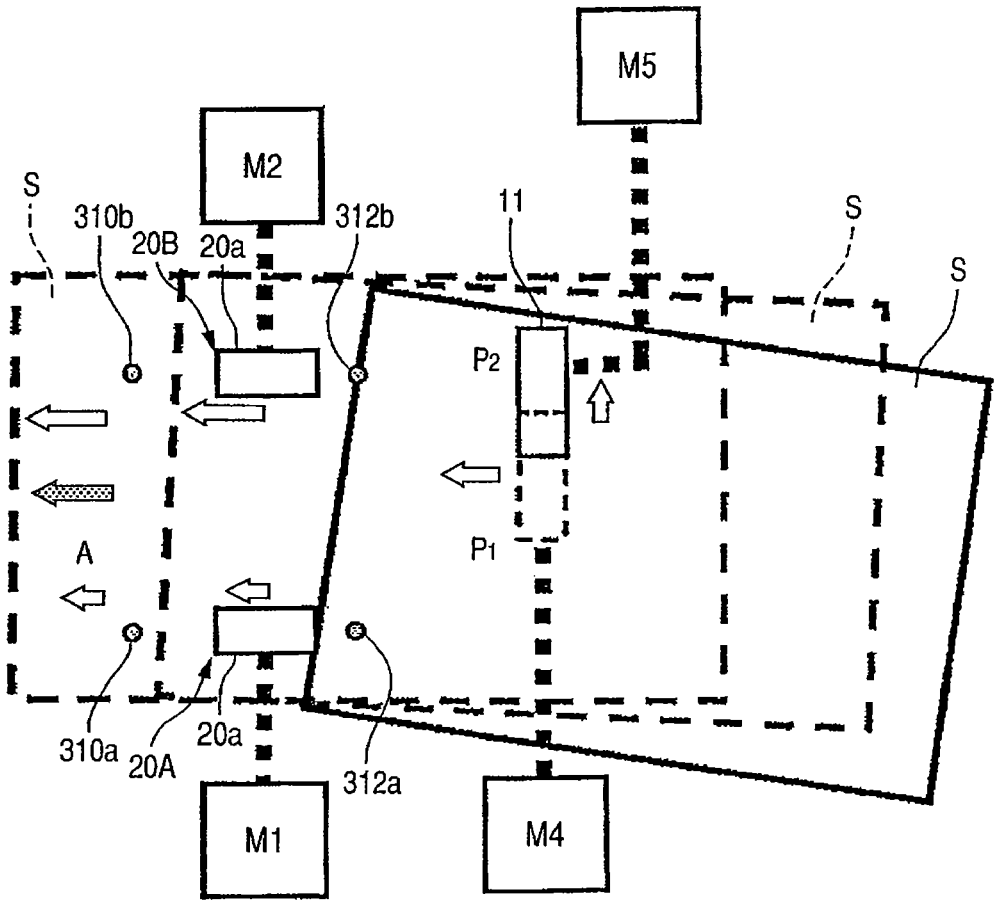
FIG. 7 is a diagram for illustrating a construction of a registration roller unit of a sheet conveying apparatus according to the second embodiment of the invention.

FIG. 7 is a diagram for illustrating a construction of a registration roller unit of a sheet conveying apparatus according to the second embodiment. In FIG. 7, the same and similar component elements as those in, for example, FIG. 3 are designated by the same reference numerals.

In FIG. 7, a conveying roller pair 11 can be moved in the lateral direction. A moving motor M4 moves the conveying roller pair 11 in the lateral direction. A conveying driving motor M5 rotates the conveying roller pair 11.

In the embodiment, control is made so as to move the conveying roller pair 11 in the lateral direction synchronously with the operation of the skew correcting roller pairs (20A, 20B). It is assumed that a movement control amount and a control speed of the conveying roller pair 11 almost coincide with a movement amount and a speed of the sheet in the nip portion of the conveying roller pair 11 which is rotated by the skew correcting roller pairs (20A, 20B).

In the embodiment, upon correcting the skew, the conveying roller pair 11 is moved from a position $P_1$ to a position $P_2$ synchronously with the operation of the skew correcting roller pairs (20A, 20B) as illustrated in FIG. 7. Since the sheet rear edge is rotated synchronously with the skew correcting operation by the skew correcting roller pairs (20A, 20B) by moving the conveying roller pair 11 as mentioned above, the conveying load which is caused when the sheet is rotated and moved by the skew correcting roller pairs (20A, 20B) is reduced.

Thus, the skew correcting precision is improved. Further, the sheet is easily torsion-deformed by providing the center-guiding portions 304 and 306 and the side-guiding surfaces 305 and 307 for the curved conveying guiding portion. Thus, even if differences occur between the shift movement amount and the shift moving speed of the conveying roller and the movement amount and the speed of the sheet in the nip portion of the conveying roller pair 11, the sheet is deformed and such differences can be absorbed.

Consequently, the conveying load which is caused when the sheet is rotated and moved can be reduced. In association with it, the skew can be precisely corrected and the shift control can be simplified.

The third embodiment of the invention will now be described.

Figure 8:
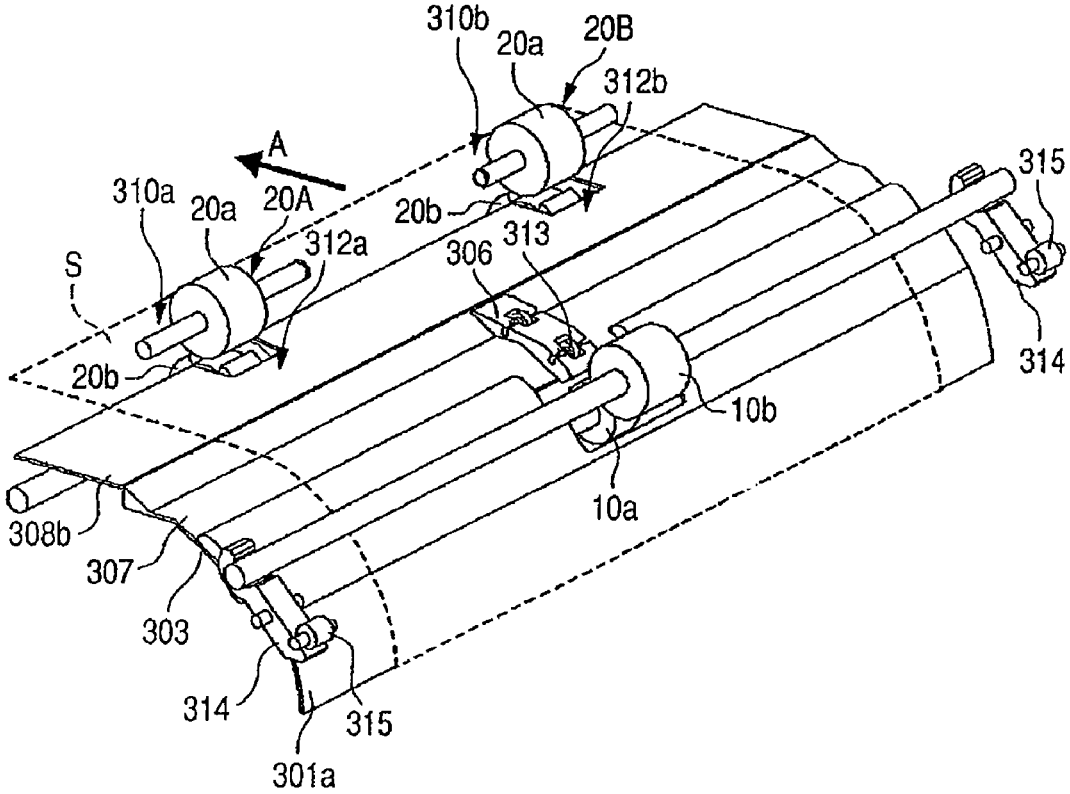
FIG. 8 is a perspective view for illustrating a construction of a registration roller unit of a sheet conveying apparatus according to the third embodiment of the invention.
Figure 9:
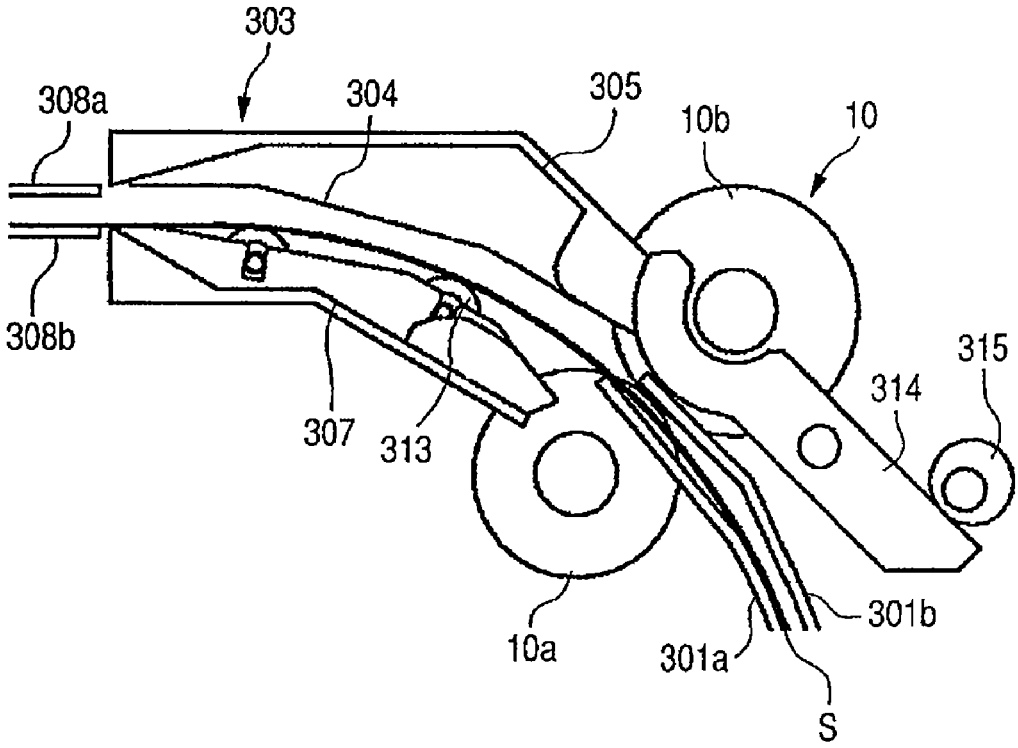
FIG. 9 is a side elevational view of the registration roller unit of the sheet conveying apparatus according to the third embodiment of the invention.

FIG. 8 is a perspective view for illustrating a construction of a registration roller unit of a sheet conveying apparatus according to the third embodiment. FIG. 9 is a side elevational view of FIG. 8. In FIGS. 8 and 9, the same and similar component elements as those in, for example, FIG. 3 are designated by the same reference numerals.

In FIGS. 8 and 9, a roller 313 is rotatably attached to the guiding surface of the inside center-guiding portion 306. By providing such a roller 313, a slide frictional resistance between the sheet S and the inside center-guiding portion 306 is reduced. Thus, the skew correcting precision can be improved and it is possible to prevent the sheet S from being damaged in a slide frictional portion.

Although the example in which the roller 313 is provided for the inside center-guiding portion 306 has been shown in FIGS. 8 and 9, one or a plurality of rollers 313 can be also provided for the guiding surface of the outside center-guiding portion 304, or one or a plurality of rollers 313 can be also provided for the guiding surfaces of both of the inside center-guiding portion 306 and the outside center-guiding portion 304.

Although the example in which the sheet is rotated and the skew is corrected by independently controlling the speeds of the two skew correcting roller pairs 20A and 20B as skew correcting units has been shown in the above description, the invention is not limited to such an example. The invention can be also applied to a construction in which, for example, a pair of rollers are provided so that they can be turned, the skew amount of the sheet which is fed in the skew state is detected by the sensor, the pair of rollers are turned in the sheet sandwiched state based on the skew amount, thereby rotating the sheet and correcting the skew.

Although the example in which the center-guiding portions 304 and 306 are provided for the downstream upper curved guide 303*b* and the downstream lower curved guide 303*a* constructing the downstream curved conveying guiding portion 303 so as to be projected has been shown above, the invention is not limited to such an example. For example, it is also possible to use a construction in which the center-guiding portion is arranged only for the downstream lower curved guide 303*a* by which the sheet is mainly guided upon skew correction and the other downstream upper curved guide 303*b* is set to the same surface shape.

Figure 10:
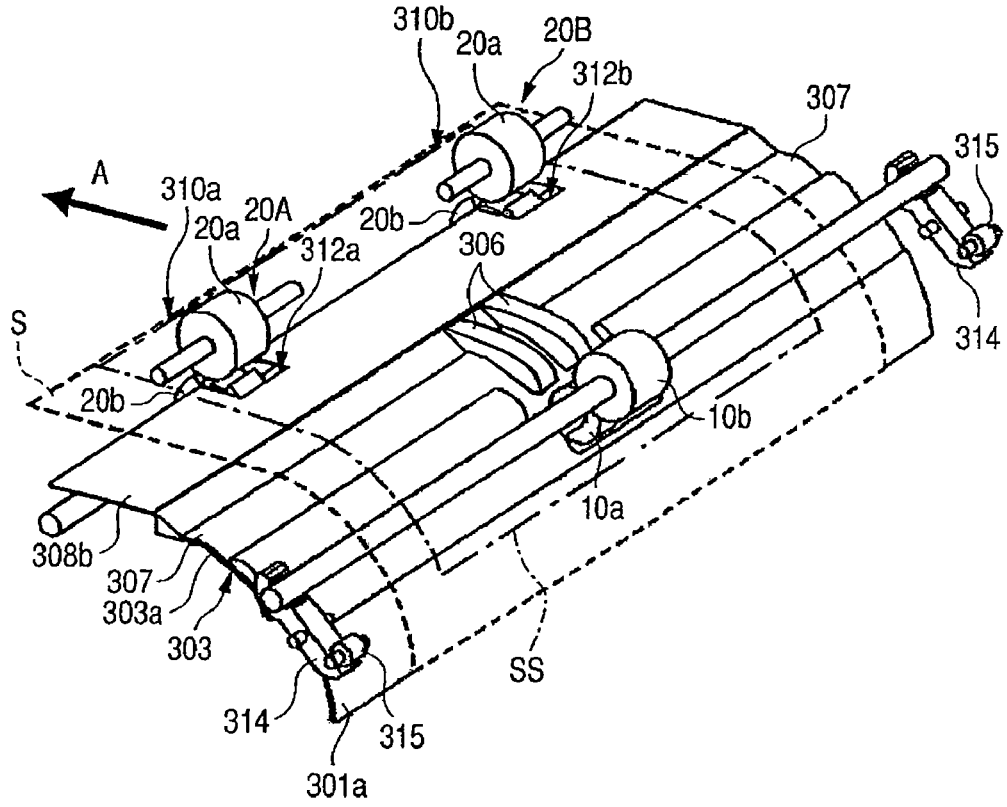
FIG. 10 is a perspective view illustrating an example in which a plurality of center guiding portions are provided.
Figure 11:
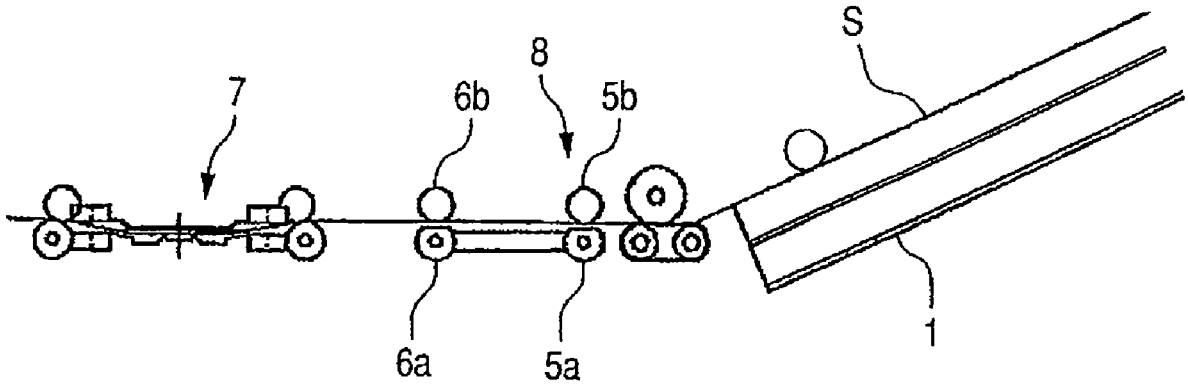
FIG. 11 is a diagram illustrating a construction of a sheet conveying apparatus for correcting a skew by a conventional active registration system.

Although the center-guiding portions 304 and 306 are provided in the center portion in the lateral direction, it is not always necessary to arrange them in the center portion so long as they exist in the width of the minimum size among the sheets which can be conveyed. That is, it is sufficient that the center-guiding portions 304 and 306 are provided at positions where the sheet of the minimum size among the sheets which can be conveyed can be come into slide contact. As illustrated in FIG. 10, a plurality of center-guiding portions 306 and 306 can be also provided instead of one center-guiding portion 306 so long as they exist in a width of sheet SS of the minimum size shown by alternate long and two-short dashes line. Similarly, a plurality of center-guiding portions 304 may be provided.

The case where the sheet conveying unit according to the invention is used for the image forming apparatus has been described above. However, the invention is not limited to such an example. For example, the invention can be also applied to an image reading apparatus such as a scanner 2000 illustrated in FIG. 1 or the like so that the sheet S can be conveyed to the image reading unit without an inclination and can be accurately positioned in the image reading unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-147174, filed May 26, 2006, which is hereby incorporated by reference herein in its entirety.

What is claimed is:

1. A sheet conveying apparatus for conveying a sheet, comprising:

a detecting unit which detects a skew amount of the sheet;

a skew correcting unit which corrects a skew of the sheet by rotating and conveying the sheet according to the skew amount detected by the detecting unit;

a conveying guiding portion which is provided on an upstream in a sheet conveying direction of the skew correcting unit and guides the sheet to the skew correcting unit; and a projecting portion provided in the conveying guiding portion, which comes into slide contact with the sheet which is rotated by the skew correcting unit so as to correct the skew.

2. A sheet conveying apparatus according to claim 1, wherein the conveying guiding portion is constructed by an upper conveying guiding member which guides an upper surface of the sheet and a lower conveying guiding member which is arranged along the upper conveying guiding member and guides a lower surface of the sheet, and the projecting portion is provided at least one of the upper conveying guiding member and the lower conveying guiding member.

3. A sheet conveying apparatus according to claim 1, wherein the conveying guiding portion is formed of curve shape and the projecting portion is provided at a position formed curve shape of the conveying guide portion.

4. A sheet conveying apparatus according to claim 1, wherein the projecting portion is arranged at a position where a sheet of a minimum size among the sheets which can be conveyed can come into slide contact with the conveying guiding portion.

5. A sheet conveying apparatus according to claim 1, further comprising a conveying roller pair which is provided in an upstream of the projecting portion and conveys the sheet toward the skew correcting unit, wherein the conveying roller pair can come into contact with and be apart from each other, and the conveying roller pair is apart from each other synchronously with a skew correcting operation of the skew correcting unit.

6. A sheet conveying apparatus according to claim 1, further comprising a conveying roller pair which is provided in an upstream of the skew correcting unit and conveys the sheet toward the skew correcting unit, wherein the conveying roller pair is movable in the lateral direction, and the conveying roller pair is moved in the lateral direction synchronously with the skew correcting operation of the skew correcting unit.

7. A sheet conveying apparatus according to claim 1, wherein the projecting portion includes a plurality of center-guiding portions provided in a center portion in a lateral direction of the conveying guiding portion.

8. An image forming apparatus has a sheet conveying apparatus for conveying a sheet and an image forming portion which forms an image onto the sheet which is conveyed by the sheet conveying apparatus, comprising:

a detecting unit which detects a skew amount of the sheet;

a skew correcting unit which corrects a skew of the sheet by rotating and conveying the sheet according to the skew amount detected by the detecting unit;

a conveying guiding portion which is provided on an upstream in a sheet conveying direction of the skew correcting unit and guides the sheet to the skew correcting unit; and a projecting portion provided in the conveying guiding portion, which comes into slide contact with the sheet which is rotated by the skew correcting unit so as to correct the skew.

9. An image forming apparatus according to claim 8, wherein the conveying guiding portion is constructed by an upper conveying guiding member which guides an upper surface of the sheet and a lower conveying guiding member which is arranged along the upper conveying guiding member and guides a lower surface of the sheet, and the projecting portion is provided at least one of the upper conveying guiding member and the lower conveying guiding member.

10. An image forming apparatus according to claim 8, wherein the conveying guiding portion is formed of curve shape and the projecting portion is provided at a position formed curve shape of the conveying guide portion.

11. An image forming apparatus according to claim 8, wherein the projecting portion is arranged at a position where a sheet of a minimum size among the sheets which can be conveyed can come into slide contact with the conveying guiding portion.

12. An image forming apparatus according to claim 8, further comprising a conveying roller pair which is provided in an upstream of the projecting portion and conveys the sheet toward the skew correcting unit, wherein the conveying roller pair can come into contact with and be apart from each other, and the conveying roller pair is apart from each other synchronously with a skew correcting operation of the skew correcting unit.

13. An image forming apparatus according to claim 8, further comprising a conveying roller pair which is provided in an upstream of the skew correcting unit and conveys the sheet toward the skew correcting unit, wherein the conveying roller pair is movable in the lateral direction, and the conveying roller pair is moved in the lateral direction synchronously with the skew correcting operation of the skew correcting unit.

14. An image forming apparatus according to claim 8, wherein the projecting portion includes a plurality of center-guiding portions provided in a center portion in a lateral direction of the conveying guiding portion.

* * * * *